US010315906B1

(12) United States Patent
Nicol et al.

(10) Patent No.: US 10,315,906 B1
(45) Date of Patent: Jun. 11, 2019

(54) WIRELESS BEVERAGE DISPENSING MONITOR

(71) Applicant: Beverage Design, LLC, Tualatin, OR (US)

(72) Inventors: Gorham Nicol, Tualatin, OR (US); James Nicol, Tualatin, OR (US)

(73) Assignee: BEVERAGE DESIGN, LLC, Tualatin, OR (US)

( * ) Notice: Subject to any disclaimer, the term of this patent is extended or adjusted under 35 U.S.C. 154(b) by 0 days.

(21) Appl. No.: 15/465,464

(22) Filed: Mar. 21, 2017

Related U.S. Application Data

(60) Provisional application No. 62/311,301, filed on Mar. 21, 2016.

(51) Int. Cl.
*B67D 1/00* (2006.01)
*B67D 1/08* (2006.01)
*B67D 1/14* (2006.01)

(52) U.S. Cl.
CPC ..... *B67D 1/0881* (2013.01); *B67D 1/0004* (2013.01); *B67D 1/0888* (2013.01); *B67D 1/1477* (2013.01)

(58) Field of Classification Search
None
See application file for complete search history.

(56) References Cited

U.S. PATENT DOCUMENTS

2008/0195251 A1* 8/2008 Milner ..... B67D 3/0035 700/237
2013/0085599 A1* 4/2013 Nicol ..... G06Q 30/06 700/233
2014/0263418 A1* 9/2014 Keating ..... B67D 3/0041 222/1
2014/0263430 A1* 9/2014 Keating ..... B67D 3/0051 222/54
2015/0284163 A1* 10/2015 Manwani ..... B67D 3/0067 222/105
2017/0158485 A1* 6/2017 Lansberry ..... B67D 3/0051

* cited by examiner

*Primary Examiner* — Roy Y Yi
*Assistant Examiner* — Geoffrey T Evans
(74) *Attorney, Agent, or Firm* — Kolitch Romano LLP

(57) ABSTRACT

The disclosed beverage dispensing monitors, systems, and methods help to track, monitor, and analyze data about beverage pours dispensed from one or more beverage dispensing taps. A beverage dispensing system can have monitors attached to one or more of its beverage dispensing taps so that when a beverage is dispensed at one of the monitored taps, the beverage poured is tracked and analyzed for many reasons like tracking inventory levels for supply and loss purposes and user training and accountability. Various data integrity analyzes can be performed and reports can be generated based on the analyzed data included data integrity reports and variance reports. The disclosed systems and methods can interface with a point-of-sale system to reconcile data of inventory and sales transactions.

22 Claims, 7 Drawing Sheets

WIRELESS BEVERAGE DISPENSING MONITOR

CROSS REFERENCE TO RELATED APPLICATION

This application claims priority from U.S. Provisional Application No. 62/311,301, filed Mar. 21, 2016, the entire content of which is incorporated herein by reference.

BACKGROUND

Beverage dispensing systems in commercial settings like restaurants, bars, stadiums, casinos, and others with large scale inventory sales tend to suffer from challenges with inventory loss, training, and transaction tracking. Many of these establishments suffer high "pour" rate costs that reflect the inventory loss that occurs in these situations. Each beverage dispensing location has a human user that physically dispenses the beverages for patrons. Oftentimes, users over-pour beverages, either intentionally or accidentally, which results in wasted inventory and lost profits. Further, these establishments tend to have high sales volumes of beverages, which generates a large amount of data and they often find inventory reconciliation with sales transaction very difficult.

Some owners use existing pour tracking systems can monitor the volume of a beverage being dispensed at a particular dispensing location by placing a flow rate sensor in-line with the dispensed beverage. However, those in-line tracking systems often cause decreased beverage pour quality, specifically with beverages like beer, because the in-line sensors disrupt the fluid flow of the beverage being dispensed. In the example of beer, the flow of the beer becomes turbulent as a result of being forced to flow over an in-line flow rate sensor which generates too much foam in the dispensed beer. If a beer is poured with too much foam, the user may choose to re-pour the beer or serve it to the patron with the risk that the patron will be dissatisfied with the quality of the beer. Also, the output from the conventional in-line flow rate systems is raw data of the volume of dispensed beverage at a particular beverage dispenser. Large establishments quickly generate immense amounts of data about beverages poured and owners are challenged to make sense of the raw data generated by the conventional systems.

The beverage dispensing art would benefit from improved beverage dispensing monitoring systems and methods that help improve accountability, data integrity, and profitability.

SUMMARY

The disclosed beverage dispensing tap monitors are attached to beverage dispensing taps that are often, although not required to be, included in a beverage dispensing system with multiple beverage sources that are connected to corresponding multiple beverage dispensing taps. The beverage dispensing tap monitors have a tilt sensor that can sense when the beverage dispensing taps are in a closed position in which no beverage is being dispensed and an open position in which beverage is being dispensed from the tap by being able to track the position of the tap handle. When the tilt sensor determines that a tap is moved from a closed position to an open position, it triggers a clock to begin timing how long the tap is open and dispensing the beverage.

The monitor has processing circuitry that generates pour data about the beverage pour that is based on the amount of time the tap is open and assigns a unique tap identifier and/or a unique pour identifier to the data. The pour data is wirelessly transmitted by a wireless transceiver to a remote computing device. The wireless transceiver continuously awaits an acknowledgement from the remote computing device that the pour data was safely received. If the acknowledgement is not received within a particular time period, the pour data is stored in local memory in, the monitor and another transmission attempt is scheduled for a later time. Additional data can be sent to the remote computing device along with the pour data including the type or brand of the dispensed beverage, the quality of the poured beverage, any ambient environment characteristics sensed around the beverage dispensing tap, and/or any other relevant information.

DETAILED DESCRIPTION

The disclosed beverage dispensing systems provide improved accountability, inventory tracking and monitoring, report generation, and reconciliation and variance analysis with sales transactions. A beverage dispensing monitor is attached to a beverage dispensing tap and can track the amount of time the tap is open and dispensing a beverage. The tracked time is sent to a reader that confirms and/or analyzes the tracked time and forwards it on to a central server and/or point-of-sale server. The beverages dispensed from the disclosed monitoring systems are most often beer but could also be wine or other beverage(s) dispensed through a beverage dispensing tap from a beverage source. The beverage source is typically remote from the beverage tap, which could mean that the beverage source is in a keg or other beverage container located in a cabinet or other housing below or near the beverage dispensing tap(s) or it could be remote like a back-room that stores multiple beverage container(s) and has a network of tubing and pumps that cause the beverage(s) to be delivered to the beverage taps for dispensing. The beverages can be chilled at the beverage source or anywhere along a pathway from the beverage source to the beverage dispensing tap. Any suitable beverage delivery system can be used in the disclosed beverage dispensing systems.

Figure 1:
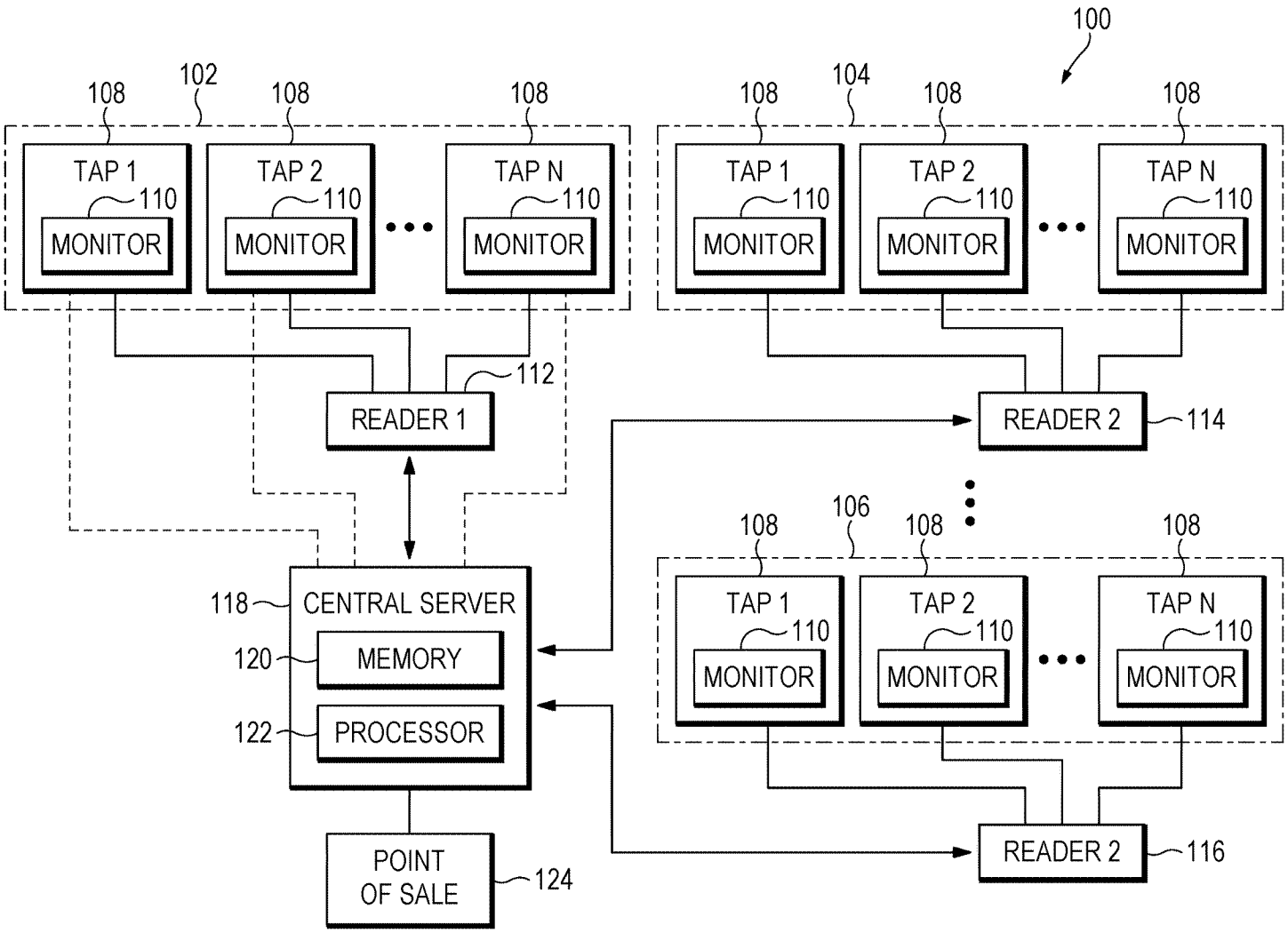
FIG. 1 shows a system block diagram of an example beverage dispensing system disclosed herein.

FIG. 1 shows an example beverage dispensing system 100 having multiple groups of beverage dispensing taps 102, 104, 106. Each group has multiple taps 108 that each have an attached beverage dispensing monitor 110. Any desired number of taps are included in each group, as needed. Each of the beverage dispensing taps 108 are wirelessly coupled to respective local readers 108, 110, 112. Each group of beverage dispensing taps 102, 104, 106 is physically located within a range of its respective wireless reader 112, 114, or 116. In some examples, the beverage dispensing taps 108 in each group are physically positioned together along a manifold (not shown) set up at a beverage service station. The beverage dispensing monitors 110 sense the volume of beverage dispensed from each tap 108 and generate pour data that includes the volume of beverage dispensed. The pour data can also include additional information about the poured beverage and other data like characteristics about the beverage dispensing system, the quality of the beverage, the temperature of the beverage, any characteristic of the ambient environment, information from other system sensors, and the like.

The readers 112, 114, 116 are typically located relatively local to the taps to which they are wirelessly connected. The wireless connection can be any suitable wireless network protocol and in some examples is a short range wireless connectivity standard like Bluetooth®. The readers 112, 114, 116 serve as a base station for their connected beverage dispensing taps and receive the transmitted data from each tap. The readers 112, 114, 116 transmit an acknowledgement back to the sending beverage dispensing tap when a transmission with pour data is received. The readers can store and analyze the received data in some examples before transmitting it along to a central server 118. The central server 118 stores the pour data in memory 120 and its processor can perform various analyses on the data, as desired.

The central server 118 can optionally interface with a point-of-sale 124 system like a conventional system that manages beverage pour transactions. The point-of-sale system 124 can be a conventional or custom point-of-sale server 124 with associated transaction software that permits users like bartenders and servers to enter patron orders and generate bills for the patron purchases. Conventional point-of-sale software only focuses on the input transaction of the user entering data into the system and does not track the actual inventory that is output from the system, whether to a customer or otherwise. Having a point-of-sale software system interface with the disclosed beverage dispensing tap monitors improves user accountability, inventory tracking, system integrity, and profit margin. The point-of-sale systems generate transaction data, such as the number and type of beverages that are entered as a purchase for a patron. That generated point-of-sale data can be compared to the data generated by the disclosed monitors, which compares the transaction data with the actual pour data. Such a comparison between transaction data and actual pour data can be performed in any suitable way and any type of output can be generated. In some examples, comparisons are made between the two data sets to identify discrepancies while other more complex analysis can be performed in other example systems such as variance analysis, system analysis, user accountability analysis, and the like. The output of the analysis between the point-of-sale transaction data and the pour data can be compiled into a report of any kind, such as a variance report. The reports can be customizable if desired by selecting specific data to analyze, such as data from a specific user or data related to a particular beverage and the like.

Figure 2:
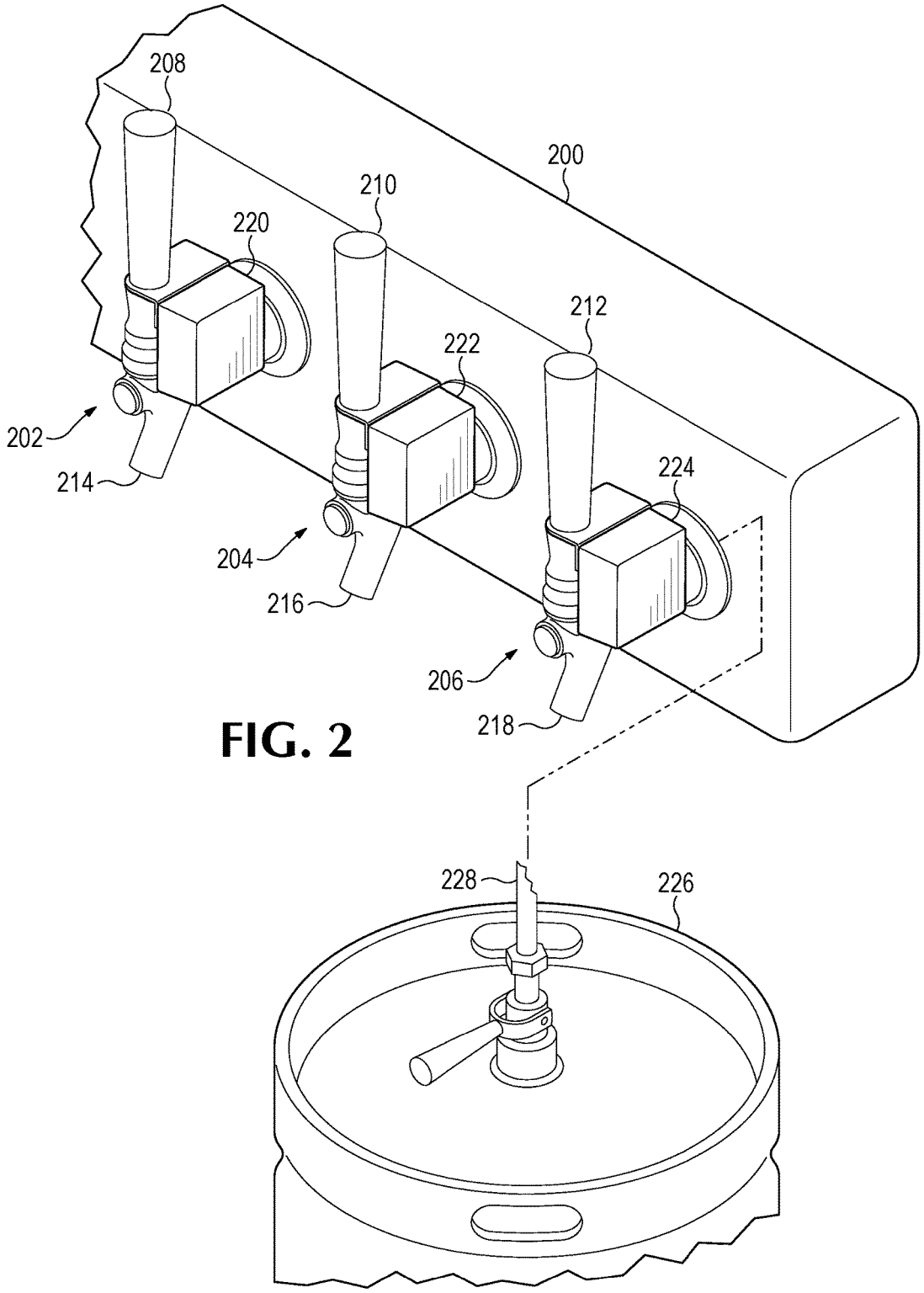
FIG. 2 shows example multiple beverage dispensing taps with attached, respective beverage dispensing monitors.

FIG. 2 shows a partial manifold showing three beverage dispensing taps 202, 204, 206 that each have respective handles 208, 210, 212 and spouts 214, 216, 218. Beverage dispensing tap monitors 220, 222, 224 are attached to the handles 208, 210, 212 of each respective beverage dispensing tap 202, 204, 206. When a user moves a handle of a tap, the beverage dispensing tap monitor moves in unison with the handle. The beverage dispensing monitors 220, 222, 224 are shown attached to an exterior surface of the beverage dispensing taps 202, 204, 206 and do not physically contact the beverage at any time while the beverage is being dispensed or flowing through the beverage dispensing taps 202, 204, 206. Because the beverage dispensing monitors 220, 222, 224 are attached to the exterior surface of their respective taps 202, 204, 206, they remain isolated from the flow of the beverage through the system and do not disrupt or affect beverage pour quality. In contrast, conventional flow rate sensors are physically located within the beverage line, which causes disruption of the fluid flow of the beverage that lowers beverage pour quality and user experience.

FIG. 2 shows one of its taps 206 connected to a beverage source 226 via an interconnecting beverage line 228. The beverage source 226 shown in FIG. 2 is a keg of beer although any container or beverage type could be dispensed in the disclosed systems. The beverage line 228 is shown broken to indicate that the line could be any desired length or configuration and the beverage source could be located nearby or remote from its beverage dispensing tap 206. The dashed line in FIG. 2 shows the flow path of the beverage between the beverage source 226 and the beverage dispensing tap 206.

Figure 3A:
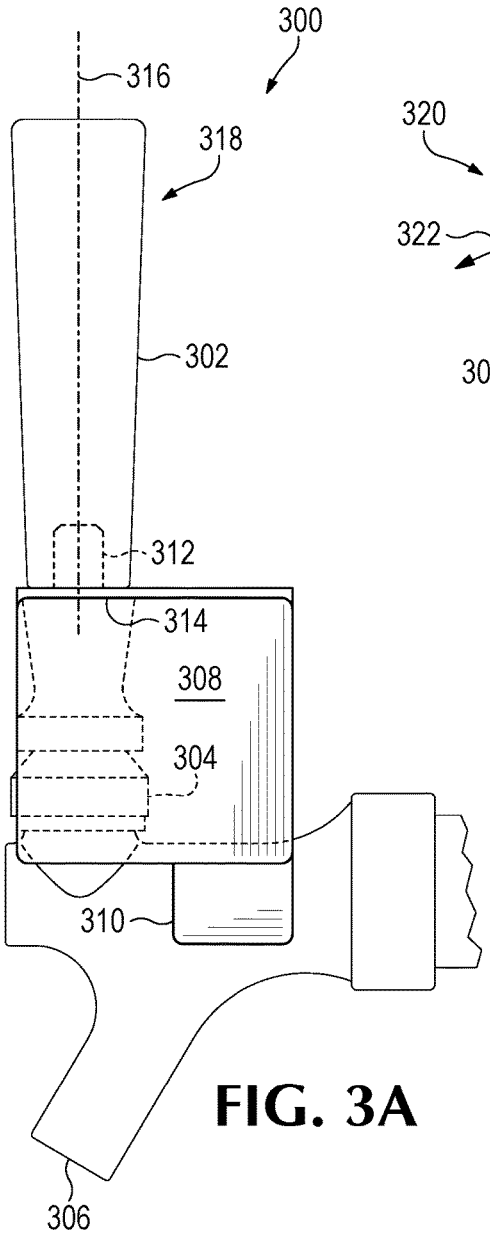
FIGS. 3A and 3B show an example beverage dispensing tap with an attached monitor in a first, closed position and a second, open position, respectively.
Figure 3B:
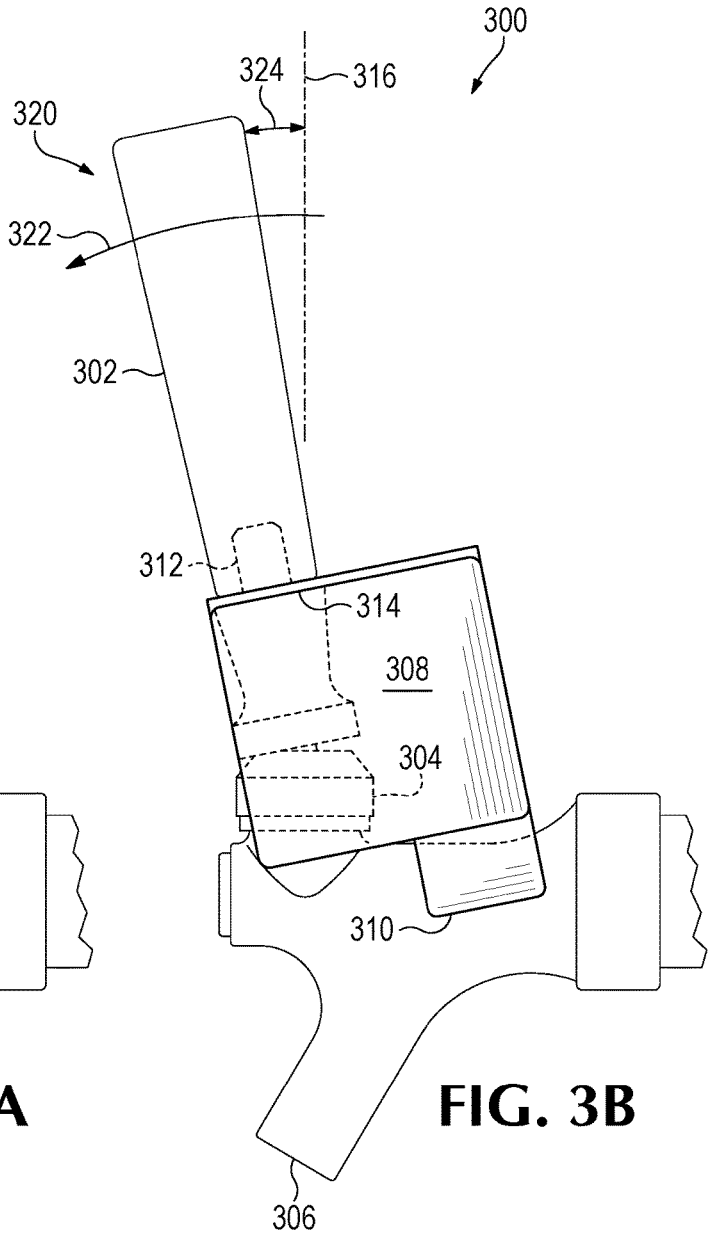

FIGS. 3A and 3B show a side view of a single beverage dispensing tap 300 in a closed position and an open position, respectively. The example beverage dispensing tap 300 has a handle 302, a body 304, and a spout 306. The beverage dispensing monitor 308 is attached to the exterior surface of one side of the beverage dispensing tap 300 by an alignment bracket 310. The handle 302 is attached to the body 304 of the beverage dispensing tap 300 by a post 312, as shown in the example in FIGS. 3A and 3B, or any other suitable mechanical connector. The alignment bracket 310 is fitted over the post through an opening (not shown) in the alignment bracket 310 to sit on a collar 314 of the body 304 of the beverage dispensing tap 300. The handle 302 is fitted onto the post 312 and secures the alignment bracket 310 between the collar 314 of the tap body 304 and the handle 302. The beverage dispensing monitor 308 is attached to the alignment bracket 310 and moves in unison with the beverage dispensing tap handle 302 continuously between a first, closed position 316 and a second, open position 318.

The first, closed position 316 prevents the beverage from flowing through the beverage spout 306 and the tap handle 302 is generally in an upright position. In the example shown in FIG. 3A, the handle 302 has an axis 312 that is approximately vertical in the closed position 316. The handle 302 shown in FIG. 3A is a standard beer tap handle that is approximately aligned vertically along the axis 312 although other beverage dispensing handles could have different configurations or designs.

To begin a beverage pour, a user engages the tap handle 302 when it is in the first, closed position 316 to pour a beverage of a chosen volume. To begin the pour, the user physically moves the handle to a second, open position 318 that allows beverage to flow through the spout 306 into a container like a glass or pitcher. In the example shown in FIGS. 3A and 3B, the handle 302 tilts towards the user when the user moves it to the second, open position 318. The motion of the handle 302 is shown by the arrow and creates an angle 322 between the handle 302 and the axis 312 as it is moved from the closed position 316 to the open position 318. The flow rate of the beverage increases as the handle progresses from the first, closed position 316 of FIG. 3A to the second, open position 318 of FIG. 3B until it reaches its maximum flow rate when the handle 302 is entirely in the second, open position 318. The beverage dispensing monitor 308 moves in unison with the tap handle 302 throughout the entire the movement of the handle 302 from the first, closed position 316 to the second, open position 318.

Figure 4:
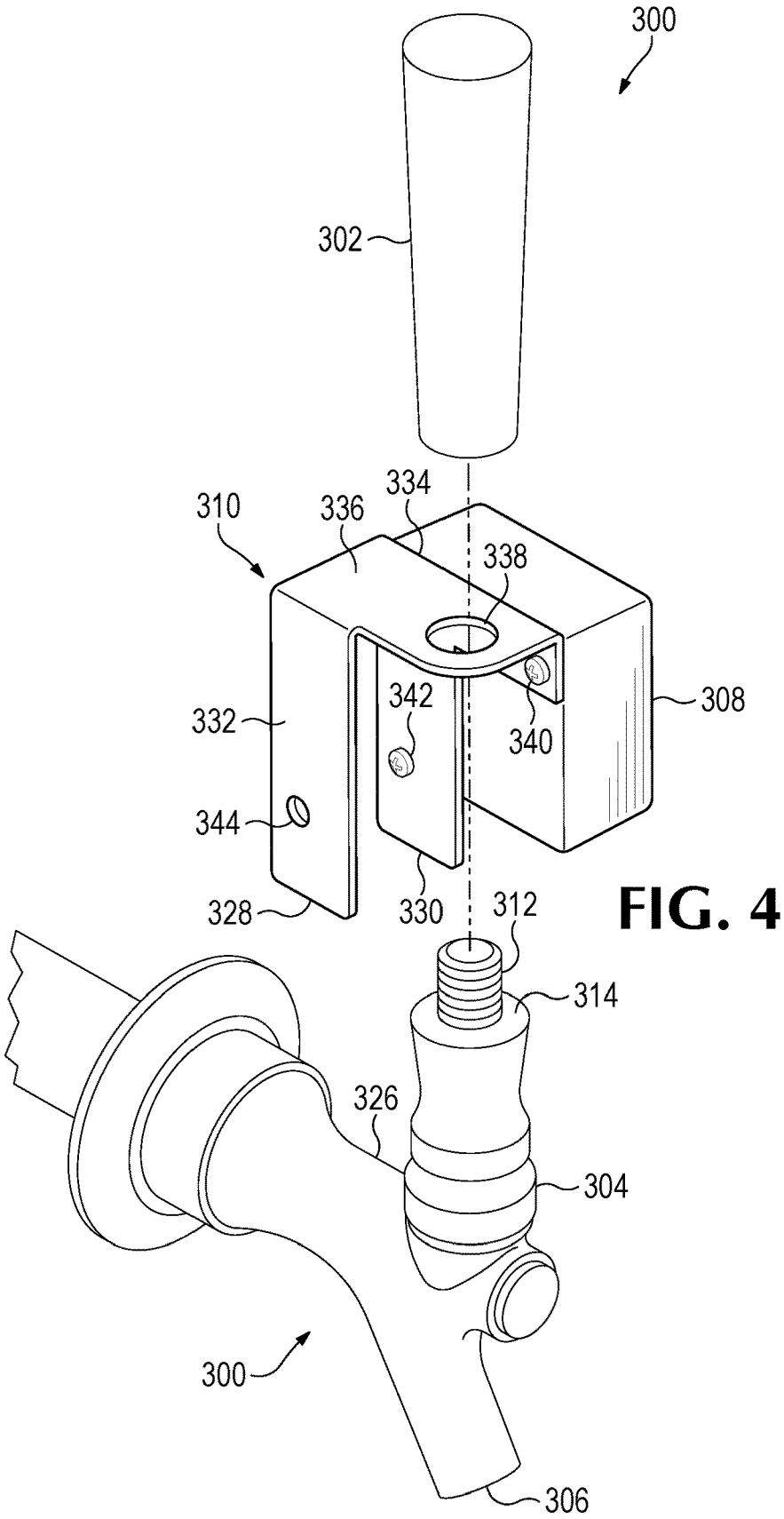
FIG. 4 shows an exploded view of an example beverage dispensing tap and a beverage dispensing tap monitor.

FIG. 4 shows an exploded view of the beverage dispensing tap and monitor of FIGS. 3A and 3B. The alignment bracket 310 is a U-shape having two generally parallel arms 328, 330 connected at respective first ends 332, 334 by a connecting surface 336. The connecting surface 336 has an opening 338 that is fitted over the post 312, which in this case is a threaded post that mates with a mating threaded cavity of the handle 302. The threaded connection between the post 312 and the handle 302 allow for a user to easily remove the handle to expose the post 312 and fit the alignment bracket 310 in place over the post 312 after which the handle 302 is replaced on the post 312 to secure the beverage dispensing monitor 308 in place. The removable handle 302, which is conventional in beverage dispensing spouts, allows for the monitors 308 to be secured to the beverage dispensing taps 300 either during their initial assembly or at any subsequent time. When the monitor 308 is properly positioned, the arms 328, 330 of the alignment bracket 310 shown in FIG. 4 are fitted on either side of the neck 324 of the spout 306 and the portion of the connecting surface 336 near the opening 338 is fitted onto the collar 314 of the body 304. The opposing portion of the connecting surface 336 is suspended above the neck 324 of the spout 306 when the alignment bracket 310 is secured to the beverage dispensing spout 300.

The beverage dispensing monitor 308 is attached to one of the arms 330 of the alignment bracket 310 with two screws 338, 340. One of the screws 338 is exposed at a position spaced apart from the tap 300 handle 302 and the body 304 that allows for easy access for a user if the monitor 308 needs to be removed from the alignment bracket 310 for any reason like maintenance or replacement. The second screw 340 is positioned near the neck 324 of the spout 306 when the alignment bracket 310 is secured to the beverage dispensing tap 300 and is accessible through a hole 342 in the opposing arm 328 of the bracket 310. A user would insert a screw driver or other removal mechanism through the hole 342 to engage with the screw 340 on the opposite arm 330.

Figure 5:
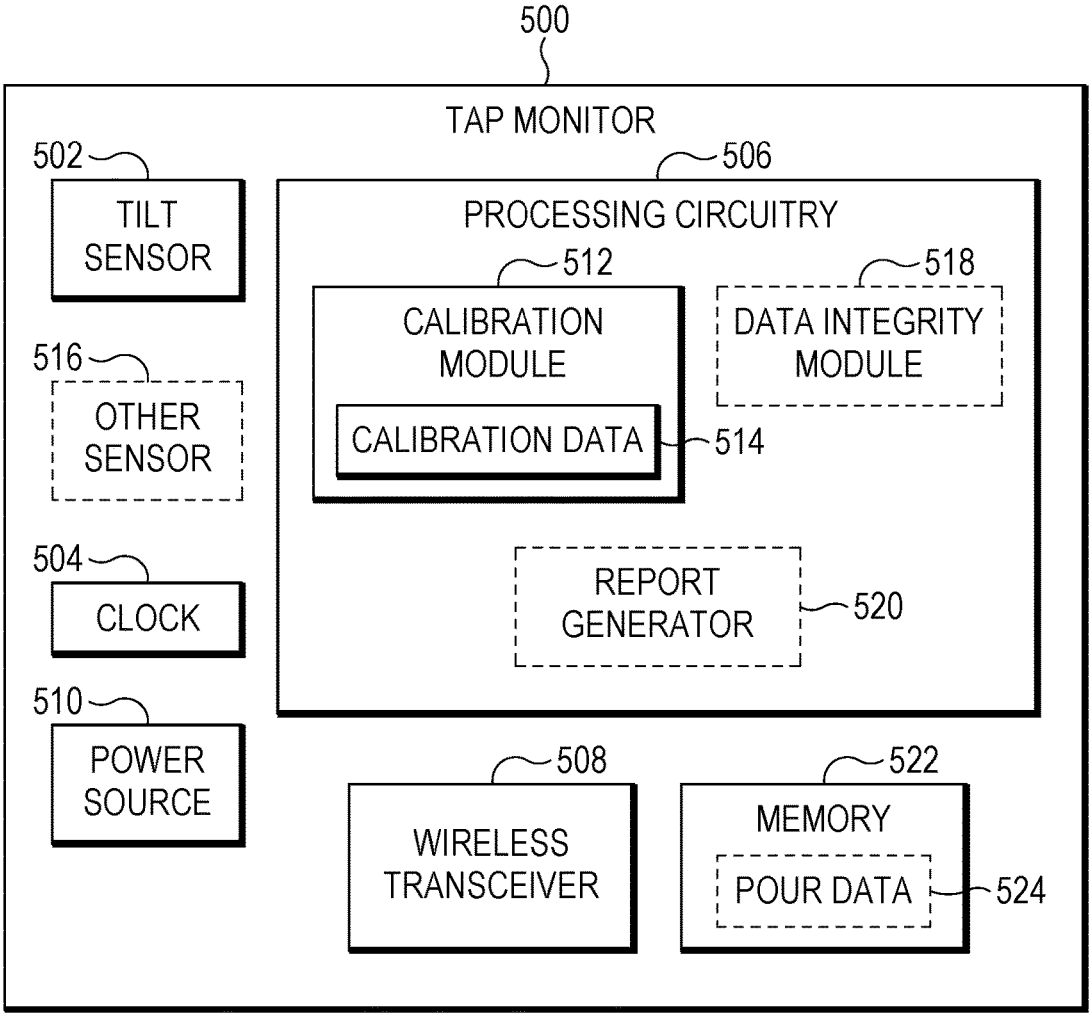
FIG. 5 is a block diagram of an example beverage dispensing tap monitor.

FIG. 5 shows a block diagram of an example beverage dispensing tap monitor 500. The tap monitor 500 includes a housing that encloses a tilt sensor 502, a clock 504, processing circuitry 506, and a wireless transceiver 508. These circuit components can be powered by an internal power source 510, such as any suitable battery. The beverage dispensing tap monitor 500 also includes a memory that is able to store sensed data from one or more sensors in the monitor 500 or elsewhere in the beverage dispensing system (not shown). The housing of the monitor 500 can be any suitable material like stainless steel or a fluid resistant or fluid impermeable plastic or other material that prevents fluid, like the beverage, from entering the housing and damaging the electronic components within. The opening perimeter of the housing (not shown) can include a gasket to help keep liquids from entering the monitor.

The tilt sensor 502 can be any suitable tilt sensor 502 that can measure and quantify a tilt of an object along one or more axes. The tilt sensor 502 can be an accelerometer that is particularly useful in determining the position of an object in motion like when the tap handle begins to move from the first, closed position to the second, open position or the reverse. Other tilt sensors can also be used, such as a ball sensor, or other alternative tilt sensors. Multiple tilt sensors can be used as well.

The tilt sensor 502 is configured to sense a position of a beverage dispensing tap in at least a first, closed position and a second, open position, i.e, the tilt sensor can sense the physical orientation of the object to which it is attached. In the case of the tilt sensor 502 being an accelerometer, the accelerometer measures an object's proper acceleration in one or more axes, it can sense any movement of the beverage dispensing tap along its typical arc pathway from its closed position to its open position. A beer tap, for example, has a handle to which the monitor with the accelerometer is attached that senses when a user engages the handle to move it towards its open position to pour the beer. Because the monitor 500, with the tilt sensor 502 housed inside the monitor 500, moves in unison with the beverage dispensing tap, the tilt sensor 502 can physically sense the movement and/or the position of the beverage dispensing tap. The tilt sensor 502, or specifically an accelerometer, can sense the position of the beverage dispensing tap when the handle is in any position and during any time throughout the movement of the handle. The tilt sensor 502 is electrically coupled to a clock 504 that can measure the amount of time that the beverage dispensing tap is in the open position.

When the tilt sensor 502 senses that a user moved the tap handle, it generates an instruction that is sent via an electrical connection to the clock 504, in some examples. The connection between the tilt sensor 502 and the clock 504 can be any suitable electronics configuration to allow the two components to be electrically coupled to each other. The instruction causes the clock 504 to begin timing the pour of the beverage being dispensed from the beverage dispensing tap. The clock 504 is any suitable timing device that can track time in response to receiving a signal. The initiation signal is received by the clock 504, the clock 504 then begins timing the pour, and awaits an instruction to stop timing the pour. When the user returns the beverage dispensing tap to its closed position, which indicates that the pour has stopped, the tilt sensor 502, or in a specific example, an accelerometer, again senses movement in the tap and generates another instruction that is sent to the clock 504 and instructs the clock 504 to stop timing the pour. After the clock 504 receives a stop instruction to cease timing the pour, the clock 504 is programmed to await a subsequent instruction to receive another pour start instruction.

The clock 504 is electrically coupled in any suitable connection to processing circuitry 506, such as a suitable micro-controller. Some examples also electrically couple the tilt sensor 502 to the processing circuitry 506 although that arrangement is optional. The clock 504 is programmed to automatically generate data with the amount of time that the beverage dispensing tap was in the open position and automatically send it to the processing circuitry 506. The processing circuitry 506 assigns a unique tap identifier and/or a unique pour identifier to the data that it receives from the clock 504. The unique tap identifier is an electronic identifier that is unique to the tap at which the beverage was dispensed. The unique pour identifier is any data that is relevant to the pour, such as timestamp data, for example. One or both of the unique tap identifier and the unique pour identifier data can be assigned to the data received from the clock 504.

The processing circuitry 506 then optionally considers data received from other sensors 516 in the system, such as temperature sensors and pour quality sensors. For examples like beer dispensing systems with multiple kegs and a network of lines and pumps that dispense beer to dispensing taps at various service station, the beer needs to be kept at a particular desired temperature or within a range of temperatures to ensure quality beer is poured at the tap. These beer dispensing systems in particular need temperature control, sometimes from the keg to the dispensing tap. In some examples, the beer tap itself is kept at a particular temperature. A temperature sensor could be secured to the beer tap or other part of the dispensing system and can electrically transmit temperature data for the portion of the system that is monitors back to the processing circuitry in the tap monitor. A temperature sensor could also be included physically inside the monitor 500 with the tilt sensor 502 and clock 504. Such a temperature sensor can be programmed to sense temperature, either continuously, on-demand, or on a pre-determined schedule, the temperature of the beverage dispensing tap 500 or any other component of the system.

A pressure sensor could also be included in the system to measure pressure in any relevant place in the system to monitor system performance or to alert users of a malfunctioning line or potential damage. Beer dispensing systems, for example, are pressurized to a pressure within a particular desired range of pressures. If the pressure falls below or rises above the desired pressure range, the system malfunctions and need service or maintenance.

The processing circuitry 506 also includes a calibration module 512. The calibration module 512 is custom information specific to the particular pathway from the beverage dispensing source to the beverage dispensing tap 500. Each tap has varying features and characteristics so the calibration module 512 has calibration data 514 that is specific to each tap. The calibration data 514 includes any objective information that affects the flow rate of the beverage through the system including the distance between the beverage source and the tap, the configuration of the pathway of the line between the beverage source and the tap, the diameter of the line connecting the beverage source and the tap, the pressure within the line or the tap, a type of line or pump used, and the like. A user may include subjective information that might affect the flow rate of the beverage from the beverage source to the tap, which includes observation data or other data gleaned from the user's experience, or the calibration data may be based entirely on the objective data. The calibration data 514 may be periodically tested for accuracy and reliability to ensure that the final determination of pour data that is output by the processing circuitry is accurate. Calibration data 514 is used to normalize the output pour data from the processing circuitry. Because each pour is adjusted to a normalized value of a pour based on the specifics of each tap's physical characteristics, the output pour data can be compared between taps that have differing physical configurations and features.

The processing circuitry 506 generates pour data that is output to a wireless transceiver 508 for transmission to a remote computing device. The pour data is based on the data received from the clock 504 about the amount of time the clock 504 determined that the tap 500 was open and the unique tap identifier and/or the unique pour identifier. The pour data may be adjusted or analyzed by the processing circuitry 506 before it is transmitted to the wireless transceiver 508 for transmission.

The wireless transceiver 508 receives the pour data from the processing circuitry 506 and wirelessly transmits it to a remote computing device. The wireless transceiver 508 both sends and receives data—it sends the pour data to the remote computing device and it awaits an acknowledgement from the remote computing device that the pour data was properly received by the remote computing device. The remote computing device can be any suitable computing device that can wirelessly communicate with the wireless transceiver 508 including a computer, like a laptop, tablet, mobile phone, or desktop computer; a central server; or a base station, like a reader, a repeater, or some other receiver. The remote computing device can have memory and processing circuitry of its own and can be wirelessly connected to multiple taps in a networked system. The remote computing device memory can store pour data from each tap to which it is wirelessly connected for later use or for system reliability to ensure that the data is backed up. The remote computing device can also perform additional analysis on the data, such as analysis of pour data from multiple taps, data integration between the multiple taps, and the like. In some examples, the remote computing device has no additional processing capabilities.

The remote computing device is programmed to generate and transmit an acknowledgement message each time it successfully receives pour data from a beverage dispensing tap. In some examples, the remote computing device generates and transmits the acknowledgement message automatically each time it receives pour data and in other examples, the remote computing device generates an acknowledgement message only when the received pour data requests an acknowledgment message. The acknowledgement message includes data that indicates that the pour data was successfully received and could include other data, if desired. The remote computing device can also generate and transmit, either automatically or upon request by the monitor in the pour data, an error message if the remote computing device receives a message that appears to have pour data for a particular tap, but the message was not safely received for any reason.

The wireless transceiver 508 can continuously await the acknowledgement from the remote computing device. For this example system, the processing circuitry 506 in the monitor 500 locally stores the pour data if an acknowledgment is not received within a particular time period. The time period can be the usual time period that the system is expected to take for the pour data to be successfully transmitted to the remote computing device. If the acknowledgement is not received within the expected time period, the processing circuitry 506 could automatically generate an instruction for the wireless transceiver to re-send the pour data to the remote computing device and again await an acknowledgement in return. This process of repeatedly trying to send the pour data and awaiting an acknowledgement in response can be performed any multiple of times.

In some examples, the processing circuitry 506 is programmed to instruct the wireless receiver 508 to make two or three attempts to send the pour data and receive an acknowledgment in response. If no acknowledgment is received in the set number of attempts, in this case two or three attempts, then the processing circuitry 506 stores the pour data 524 locally in memory 522 in the monitor 500. In some examples, the processing circuitry 500 waits for a predetermined period of time, maybe several minutes or any desired amount of time, and again tries to successfully transmit the pour data 524 to the remote computing device. The pour data 524 stored in the memory 522 of the monitor 500 can be later accessible for analysis. Oftentimes, unsuccessful pour data transmission—those that do not receive an acknowledgment in return from the remote computing device—are caused by system or transmission errors. By saving the pour data 524 locally in the memory of the tap, it is preserved and can later be retrieved after the system is repaired.

The processing circuitry 506 in the beverage dispensing tap monitors 500 can include any desired amount and type of data analysis, compilation, and processing modules. For example, the beverage dispensing tap monitor 500 shown in FIG. 5 has a data integrity module 518 that is programmed to verify the data generated for the pour data is complete and accurate before sending it to the remote computing device. Data integrity analysis could mean performing the same data analysis multiple times and can also mean that it factors in calibration data and/or data from one or more sensors in the system that might affect the pour data. For example, if a pump were to malfunction and cause beer to be dispensed at an abnormally slow rate, the time period that the tap was open would be commensurately abnormally long. The data integrity module 518 could be connected to a system sensor that monitors the pump or the pressure of the line and corrects the output pour data for such a malfunctioning system component. Many other data integrity analyses can also be performed and this disclosure is not limited on how the data integrity can be improved.

The processing circuitry 506 also can include a report generator 520 that can compile, organize, and output any desired report on any data gathered, stored, or analyzed by the monitor 500. As discussed above, some example reports include variance reports that compare the data generated by a point-of-sale server and the data generated by the monitors about the actual output of beverages. Any additional analyses of this data can be included in the reports.

Figure 6:
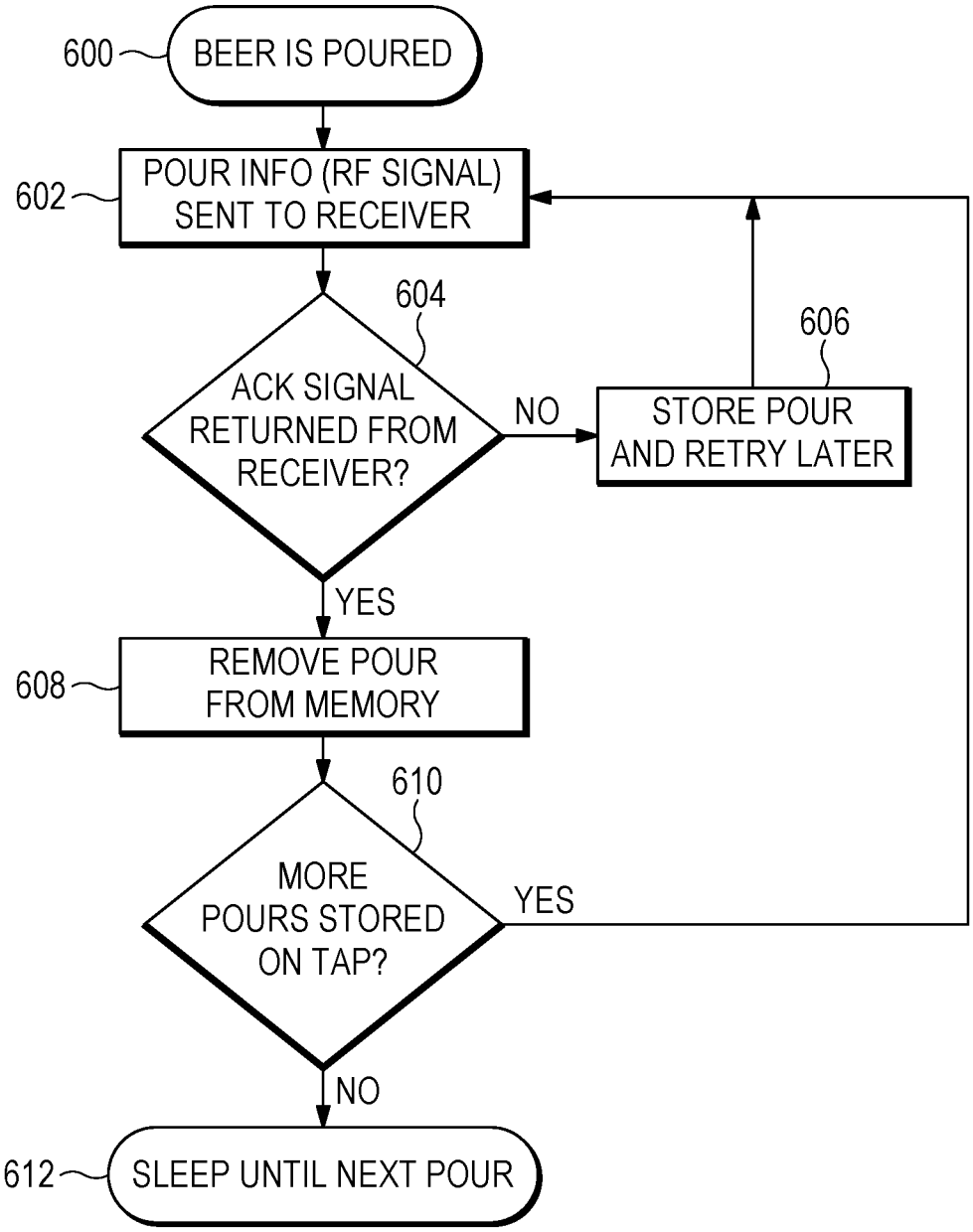
FIG. 6 is a process diagram of pour data generated and processed in an example beverage dispensing tap monitor.
Figure 7:
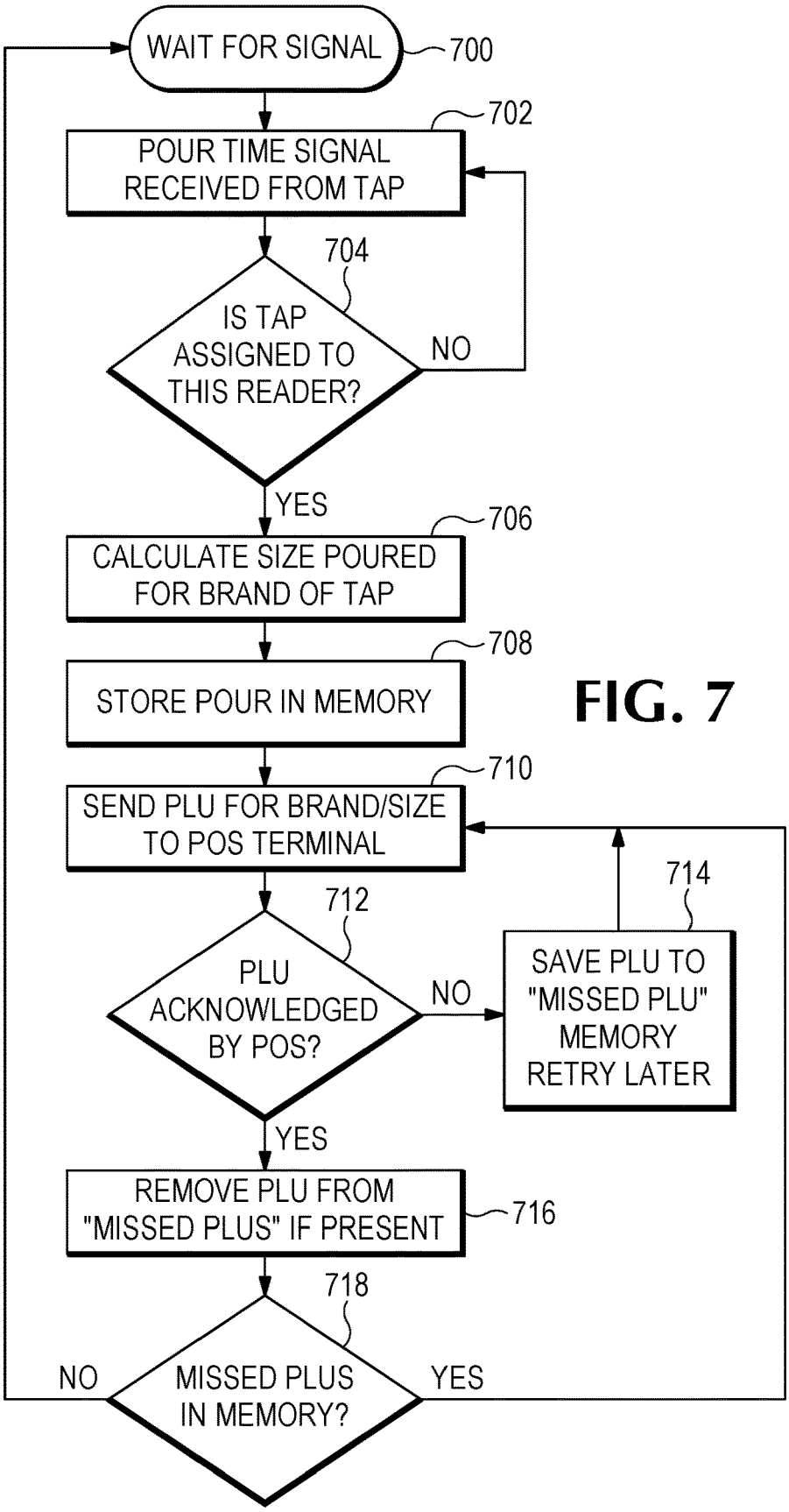
FIG. 7 is a process diagram of pour data received by a reader in an example beverage dispensing system.

FIGS. 6 and 7 show examples of the process that occurs in a beer dispensing tap as it senses a pour and communicates with its local reader. FIG. 6 starts with the beer being poured 600, which is sensed by an accelerometer and timed by a clock, as discussed above. The pour data is sent via a radio-frequency signal to a local reader 602. The transceiver in this example is a 2.4 GHz transceiver having an effective range of about 200 feet. The processing circuitry continuously awaits an acknowledgement signal from the reader 604. If the acknowledgement signal is not received, then the processing circuitry stores the pour data in the local memory of the monitor and retries to send the pour data at a later time 606. In this example, if the acknowledgement is received from the reader 604, then the pour data is removed from the local monitor memory 608, if it was ever stored there. The local monitor memory is then checked for additional pour data that is stored 610 and the process is repeated if additional pour data is determined to be stored. If additional data is not stored, then the processing circuitry instructs the beverage dispensing tap to enter a sleep mode until the next pour is sensed 612.

FIG. 7 shows examples of the process that occurs in the local readers. The readers in this example are physically located within about a 200 ft. radius of each tap to which it is wirelessly connected. The readers wait for a signal from any one of its taps 700 and receives a pour time signal from the tap 702 that indicates the amount of time that the tap was open and a beverage was being dispensed. The reader checks if the signal received is from one of the taps to which it is known to be connected 704. If the signal is from a tap that is unknown to the reader, then it is recycled back into the process to receive it again 702. Although not shown, the unknown tap from which the signal is received, could be either registered to the reader and then processed in the same manner as the other taps which are known to be connected to the reader or an error message could be returned to the unknown tap.

If the tap is a recognized tap, then the reader calculates the size of the beverage that is poured based on the known brand of the beverage 706. The known brand is associated with a particular tap and is associated with the pre-programmed calibration data, as discussed above. The calibrated pour data is then stored in the reader's memory 708 and the product look-up unit or PLU for the dispensed beverage with the calibrated pour data is sent to the point-of-sale user station that received the patron transaction 710. The reader awaits an acknowledgement from the point-of-sale user station. If the acknowledgement is not received, then the calibrated pour data and PLU is saved to the reader memory and the reader attempts transmission of this data to the point-of-sale user station at a later time 714. If the reader receives an acknowledgment that the calibrated pour data and PLU are received by the point-of-sale user station, then the calibrated pour data and PLU are removed from the reader memory 716. The reader memory is also checked for any missed calibrated data and PLUS related to stored pours that were not transmitted properly 718.

Although there has been described to this point particular embodiments for a method and apparatus for beverage dispensing systems, it is not intended that such specific references be considered as limitations upon the scope of this invention except in-so-far as set forth in the following claims.

What is claimed is:

1. A beverage dispensing monitor, comprising:

a tilt sensor coupled to a beverage dispensing tap and isolated from a beverage flow through the tap, the sensor configured to sense a position of the beverage dispensing tap in at least a first, closed position and a second, open position;

a clock electrically coupled to the tilt sensor and configured to measure a time period during which the beverage dispensing tap is in the second, open position;

processing circuitry configured to:

receive data from the clock that includes the time period during which the beverage dispensing tap is in the second, open position;

assign one or both of a unique tap identifier and a unique pour identifier to the data received from the clock; and generate pour data based, at least in part, on the data received from the clock and the one or both of the unique tap identifier and the unique pour identifier;

a wireless transceiver configured to:

receive the pour data from the processing circuitry;

wirelessly transmit the pour data to a remote computing device; and continuously await an acknowledgement from the remote computing device that the pour data was properly received by the remote computing device; and memory configured to store the pour data if the acknowledgement from the remote computing device is not received within a predetermined period of time.

2. The beverage dispensing monitor of claim 1, wherein the tilt sensor comprises an accelerometer.

3. The beverage dispensing monitor of claim 1, wherein the tilt sensor is further configured to sense the position of the beverage dispensing tap throughout its movement from the first, closed position to the second, open position.

4. The beverage dispensing monitor of claim 1, wherein, in response to sensing the position of the beverage dispensing tap is moved from the first, closed position to the second, open position, the tilt sensor is further configured to generate and send an instruction to the clock to begin timing for the time period.

5. The beverage dispensing monitor of claim 4, wherein, in response to sensing the position of the beverage dispensing tap is moved from the second, open position back to the first, closed position, the tilt sensor is further configured to generate and send an instruction to the clock to stop timing for the time period.

6. The beverage dispensing monitor of claim 1, wherein the processing circuitry includes a calibration module that includes calibration data specific to the beverage dispensing tap, and wherein the processing circuitry is configured to generate the pour data based, at least in part, on the calibration data and the time period during which the beverage dispensing tap is in the second, open position.

7. The beverage dispensing monitor of claim 6, wherein the calibration data is customized for the beverage dispensing tap based on one or more features relating to the beverage dispensing tap, a beverage source configured to supply beverage to the beverage dispensing tap, or any combination thereof.

8. The beverage dispensing monitor of claim 1, wherein the processing circuitry is further configured to analyze the data from the clock and one or both of the unique tap identifier and the unique pour identifier and calculate a volume of the beverage dispensed from the beverage dispensing tap during the time period, the processing circuitry further configured to generate the pour data based on the volume of the beverage dispensed from the beverage dispensing tap.

9. The beverage dispensing monitor of claim 1, wherein the beverage dispensing monitor further includes a power source configured to provide power to one or more or any combination of the tilt sensor, the clock, the processing circuitry, the wireless transceiver, and the memory.

10. The beverage dispensing monitor of claim 1, wherein the wireless transceiver is configured to wirelessly transmit the pour data to a reader, the reader wirelessly coupled to a central server and having a memory configured to store the pour data.

11. The beverage dispensing monitor of claim 10, further comprising a point-of-sale server that is configured to store and execute computer-readable instructions relating to point-of-sale transactions for one or more points of sale and to transmit the point-of-sale transactions to the remote computing device.

12. The beverage dispensing monitor of claim 1, wherein the remote computing device is one or both of a reader, a central server, or any multiples of combinations thereof.

13. The beverage dispensing monitor of claim 1, wherein the processing circuitry further comprises a data integrity module configured to automatically analyze one or more of the time period from the clock, the unique tap identifier, and the pour data based on one or more of data integrity characteristics and data variance characteristics or any multiples or combinations thereof.

14. The beverage dispensing monitor of claim 1, wherein the clock is further configured to timestamp the pour data before it is wirelessly transmitted to the remote computing device.

15. The beverage dispensing monitor of claim 1, further comprising an alignment bracket coupled to the tilt sensor, wherein the alignment bracket includes a U-shaped pair of parallel arms connected at respective first ends by a connecting surface having an opening configured to mate with a handle of the beverage dispensing tap, such that the parallel arms are disposed on opposite sides of a neck of the tap and the tilt sensor tilts with the handle.

16. A beverage dispenser, comprising:

a beverage dispensing tap having a selectively removable handle;

a beverage dispenser monitor having a housing that includes:

a tilt sensor isolated from a flow of fluid through the tap, the tilt sensor configured to sense a position of the beverage dispensing tap in at least a first, closed position and a second, open position;

a clock electrically coupled to the tilt sensor and configured to measure a time period during which the beverage dispensing tap is in the second, open position;

processing circuitry configured to:

receive data from the clock that includes the time period during which the beverage dispensing tap is in the second, open position;

assign one or both of a unique tap identifier and unique pour identifier data to the data received from the clock; and generate pour data based, at least in part, on the data received from the clock and one or both of the unique tap identifier and the unique pour identifier data;

analyze the on one or more or any combination of the time period from the clock, the one or both of the unique tap identifier and the unique pour identifier data, and the pour data based on data integrity characteristics;

a wireless transceiver configured to:

receive the pour data from the processing circuitry;

wirelessly transmit the pour data to a remote computing device; and continuously await an acknowledgement from the remote computing device that the pour data was properly received by the remote computing device; and memory configured to store the pour data if the acknowledgement from the remote computing device is not received within a predetermined period of time; and an attachment element secured to the housing and shaped to affix the beverage dispensing monitor to the beverage dispensing tap and to cause the tilt sensor to move in unison with the beverage dispensing tap between the first, closed position and the second, open position.

17. The beverage dispenser of claim 16, wherein the data integrity characteristics upon which the processing circuitry analyzes the time period from the clock, the unique tap identifier, and the pour data includes variance data for the beverage dispensing tap that is generated by a remote point-of-sale server.

18. The beverage dispenser of claim 16, wherein the processing circuitry further comprises a report generator that is configured to generate one or both of a data integrity report and a variance report based, at least in part, on the one or more of the data integrity and the data variance analysis.

19. The beverage dispenser of claim 16, wherein the processing circuitry further comprises a report generator that is configured to automatically generate one or both of a data integrity report and a variance report based, at least in part, on the one or more of the data integrity and the data variance analysis.

20. The beverage dispenser of claim 16, wherein continuously awaiting the acknowledgement includes the processing circuitry being configured to send a first attempt to transmit the pour data to the remote computing device and if no acknowledgement is received from the remote computing device within a first time period, then sending a second attempt to transmit the pour data to the remote computing device, and if no acknowledgement is received from the remote computing device within a second time period, then saving the pour data to the memory and generating an instruction for the processing circuitry to send a third attempt to transmit the pour data to the remote computing device at a subsequent third time.

21. The beverage dispenser of claim 16, wherein the clock is further configured to timestamp the pour data before it is wirelessly transmitted to the remote computing device.

22. The beverage dispenser of claim 16, wherein the selectively removable handle is coupled to a post of the tap, and further comprising an alignment bracket coupled to the housing of the beverage dispenser monitor, wherein the alignment bracket includes a pair of parallel arms connected at respective first ends in a U-shape by a connecting surface removably mated with the post, such that the parallel arms are disposed on opposite sides of a neck of the tap and the housing tilts with the handle.

* * * * *